US006309276B1

(12) United States Patent
Tsai et al.

(10) Patent No.: US 6,309,276 B1
(45) Date of Patent: Oct. 30, 2001

(54) ENDPOINT MONITORING WITH POLISHING RATE CHANGE

(75) Inventors: Stan Tsai; Fred C. Redeker, both of Fremont; Kapila Wijekoon, Santa Clara, all of CA (US)

(73) Assignee: Applied Materials, Inc., Santa Clara, CA (US)

( * ) Notice: Subject to any disclaimer, the term of this patent is extended or adjusted under 35 U.S.C. 154(b) by 0 days.

(21) Appl. No.: 09/495,616

(22) Filed: Feb. 1, 2000

(51) Int. Cl.[7] ..... B24B 1/00

(52) U.S. Cl. ..... 451/5; 451/6; 451/7; 451/9; 451/41; 451/57

(58) Field of Search ..... 451/5, 6, 7, 9, 451/41, 285–288, 57; 438/692–694; 252/79.4

(56) References Cited

U.S. PATENT DOCUMENTS

| | | | |
|---|---|---|---|
| 4,179,852 | 12/1979 | Barnett . | |
| 5,081,796 | 1/1992 | Schultz . | |
| 5,413,941 | 5/1995 | Koos et al. . | |
| 5,433,651 | 7/1995 | Lustig et al. . | |
| 5,593,343 | 1/1997 | Bauer . | |
| 5,605,760 | 2/1997 | Roberts . | |
| 5,640,242 | 6/1997 | O'Boyle et al. . | |
| 5,651,160 | 7/1997 | Yonemizu et al. . | |
| 5,672,091 | 9/1997 | Takahashi et al. . | |
| 5,791,969 | 8/1998 | Lund . | |
| 5,838,447 | 11/1998 | Hiyama et al. . | |
| 5,851,135 * | 12/1998 | Sandhu et al. | 451/5 |
| 5,872,633 | 2/1999 | Holzapfel et al. . | |
| 5,893,796 | 4/1999 | Birang et al. . | |
| 5,949,927 | 9/1999 | Tang . | |
| 5,964,643 | 10/1999 | Birang et al. . | |
| 6,012,970 | 1/2000 | Nagabushnam et al. . | |
| 6,068,539 * | 5/2000 | Bajaj et al. | 451/6 |

FOREIGN PATENT DOCUMENTS

| | | |
|---|---|---|
| 881 040 A2 | 12/1998 | (EP) . |
| 881 484 A2 | 12/1998 | (EP) . |
| 2 334 470 | 8/1999 | (GB) . |
| 62-222479 | 9/1987 | (JP) . |
| 3-234467 | 10/1991 | (JP) . |
| 10-98960 | 4/1995 | (JP) . |

* cited by examiner

*Primary Examiner*—Joseph J. Hail, III
*Assistant Examiner*—George Nguyen
(74) *Attorney, Agent, or Firm*—Fish & Richardson

(57) ABSTRACT

A substrate with a first layer disposed on a second layer is chemically mechanically polished. A polishing endpoint detection system generates a signal that is monitored for an endpoint criterion. The polishing rate of the substrate is reduced when the bulk of the first layer has been removed but before the second layer is exposed. For example, the polishing rate is reduced when the polishing time approaches an expected polishing end time but before the endpoint criterion is detected. Polishing stops once the endpoint criterion is detected after the underlying layer has been exposed.

19 Claims, 4 Drawing Sheets

ENDPOINT MONITORING WITH POLISHING RATE CHANGE

BACKGROUND

The present invention relates generally to chemical mechanical polishing of substrates, and more particularly to methods and apparatus for detecting a polishing end-point during a chemical mechanical polishing operation.

An integrated circuit is typically formed on a substrate by the sequential deposition of conductive, semiconductive or insulative layers on a silicon wafer. After each layer is deposited, the layer is etched to create circuitry features. As a series of layers are sequentially deposited and etched, the outer or uppermost surface of the substrate, i.e., the exposed surface of the substrate, becomes increasingly non-planar. This non-planar surface presents problems in the photolithographic steps of the integrated circuit fabrication process. Therefore, there is a need to periodically planarize the substrate surface.

Chemical mechanical polishing (CMP) is one accepted method of planarization. This planarization method typically requires that the substrate be mounted on a carrier or polishing head. The exposed surface of the substrate is placed against a rotating polishing disk-shaped pad or belt pad. The polishing pad may be either a "standard" pad or a fixed-abrasive pad. A standard pad has a durable roughened surface, whereas a fixed-abrasive pad has abrasive particles held in a containment media. The carrier head provides a controllable load, i.e., pressure, on the substrate to push it against the polishing pad. A polishing slurry, including at least one chemically-reactive agent, and abrasive particles if a standard pad is used, is supplied to the surface of the polishing pad.

One problem in CMP is determining whether the polishing process is complete, i.e., whether a substrate layer has been planarized to a desired flatness or thickness. Variations in the initial thickness of the substrate layer, the slurry composition, the polishing pad condition, the relative speed between the polishing pad and the substrate, and the load on the substrate can cause variations in the material removal rate. These variations cause variations in the time needed to reach the polishing endpoint. Therefore, the polishing endpoint cannot be determined merely as a function of polishing time.

One way to determine the polishing endpoint is to remove the substrate from the polishing surface and examine it. For example, the substrate may be transferred to a metrology station where the thickness of a substrate layer is measured, e.g., with a profilometer or a resistivity measurement. If the desired specifications are not met, the substrate is reloaded into the CMP apparatus for further processing. This is a time consuming procedure that reduces the throughput of the CMP apparatus. Alternatively, the examination might reveal that an excessive amount of material has been removed, rendering the substrate unusable.

More recently, in-situ optical monitoring of the substrate has been performed, e.g., with an interferometer or reflectometer, in order to detect the polishing endpoint. For example, when polishing a metal layer to expose an underlying insulative or dielectric layer, the reflectivity of the substrate will drop abruptly when the metal layer is removed. However, as the substrate is being polished, the polishing pad condition and the slurry composition at the pad-substrate interface may change. Such changes may mask the exposure of an underlying layer, or they may imitate an endpoint condition. Thus, even when there is a sharp change in reflectivity, it may be difficult to determine the proper polishing endpoint. Moreover, endpoint detection can be even more difficult if oxide or nitride polishing is to be performed, if only planarization is being performed, if the underlying layer is to be over-polished, or if the underlying layer and the overlying layer have similar physical properties.

Another reoccurring problem in CMP is so-called "dishing" in the substrate surface. Specifically, during CMP to expose an underlying layer, when the underlying layer is exposed, the portion of a filler layer between the raised areas of the patterned underlying layer can be overpolished, creating concave depressions in the substrate surface. Dishing can render the substrate unsuitable for integrated circuit fabrication, lowering process yield.

SUMMARY

In one aspect, the invention is directed to a computer-implemented endpoint detection method for a chemical mechanical polishing operation. In the method, a polishing time of a substrate being polishing by a chemical mechanical polishing system is measured. A signal is received from a polishing endpoint detection system, and the signal is monitored for an endpoint criterion. A polishing parameter of the chemical mechanical polishing operation is modified so as to reduce a polishing rate of a substrate being polished when the polishing time approaches an expected polishing end time but before the endpoint criterion is detected. Polishing stops once the endpoint criterion is detected.

Implementations of the invention may include the following features. The endpoint detection system may optically monitor the substrate. The polishing operation may polish a metal layer or a dielectric layer. The time to modify the polishing parameter may be stored as a default time calculated from the signal received from the endpoint monitoring system. Modifying the polishing parameter can includes reducing a pressure on the substrate or reducing a relative speed between the substrate and a polishing surface. The substrate may includes a first layer, e.g., copper, disposed over a second layer, e.g., silicon oxide, and the polishing rate may be is reduced before the second layer is exposed.

In another aspect, the invention is directed to a method of chemical mechanical polishing in which a substrate into contact with a polishing surface and relative motion is created between the substrate and the polishing surface. A polishing time of the substrate is measured, a signal is generated with a polishing endpoint detection system, and the signal is monitored for an endpoint criterion. A polishing rate of the substrate is reduced when the polishing time approaches an expected polishing end time but before the endpoint criterion is detected. Polishing is stopped once the endpoint criterion is detected.

Implementations of the invention may include the following features. The endpoint detection system may optically monitor the substrate. Changing the polishing parameter can includes reducing a pressure on the substrate or reducing a relative speed between the substrate and the polishing surface.

In another aspect, the invention is directed to a method of chemical mechanical polishing a substrate having a first layer disposed on a second layer. In the method, the first layer of the substrate is brought into contact with a polishing surface and relative motion between the substrate and the polishing surface is created to polish the first layer of the substrate. A polishing rate of the substrate is reduced before the second layer is exposed, and polishing is stopped after the underlying layer has been exposed.

Implementations of the invention may include the following features. Reducing the polishing rate may include measuring a polishing time of the substrate with a computer, storing a parameter change time in the computer, and modifying a polishing parameter when the polishing time reaches the parameter change time. Stopping polishing can include generating a signal with a polishing endpoint detection system, monitoring the signal for an endpoint criterion, and stopping polishing once the endpoint criterion is detected.

In another aspect, the invention is directed to a chemical mechanical polishing apparatus that has a polishing surface, a carrier head to hold a substrate into contact with the polishing surface, a motor coupled to at least one of the polishing surface and the carrier head to create relative motion therebetween, a polishing endpoint detection system, and a controller to receive a signal from the endpoint detection system. The controller is configured to measure a polishing time of a substrate during a polishing operation, monitor the signal for an endpoint criterion, modify a polishing parameter so as to reduce a polishing rate of the substrate when the polishing time approaches an expected polishing end time but before the endpoint criterion is detected, and stop polishing of the substrate once the endpoint criterion is detected.

Potential advantages of implementations of the invention can include zero or more of the following. The polishing endpoint can be determined more accurately. In addition, the point at which the polishing apparatus should change switch polishing parameters can be determined more accurately.

Other features and advantages of the invention will become apparent from the following description, including the drawings and claims.

DETAILED DESCRIPTION

Figure 1:
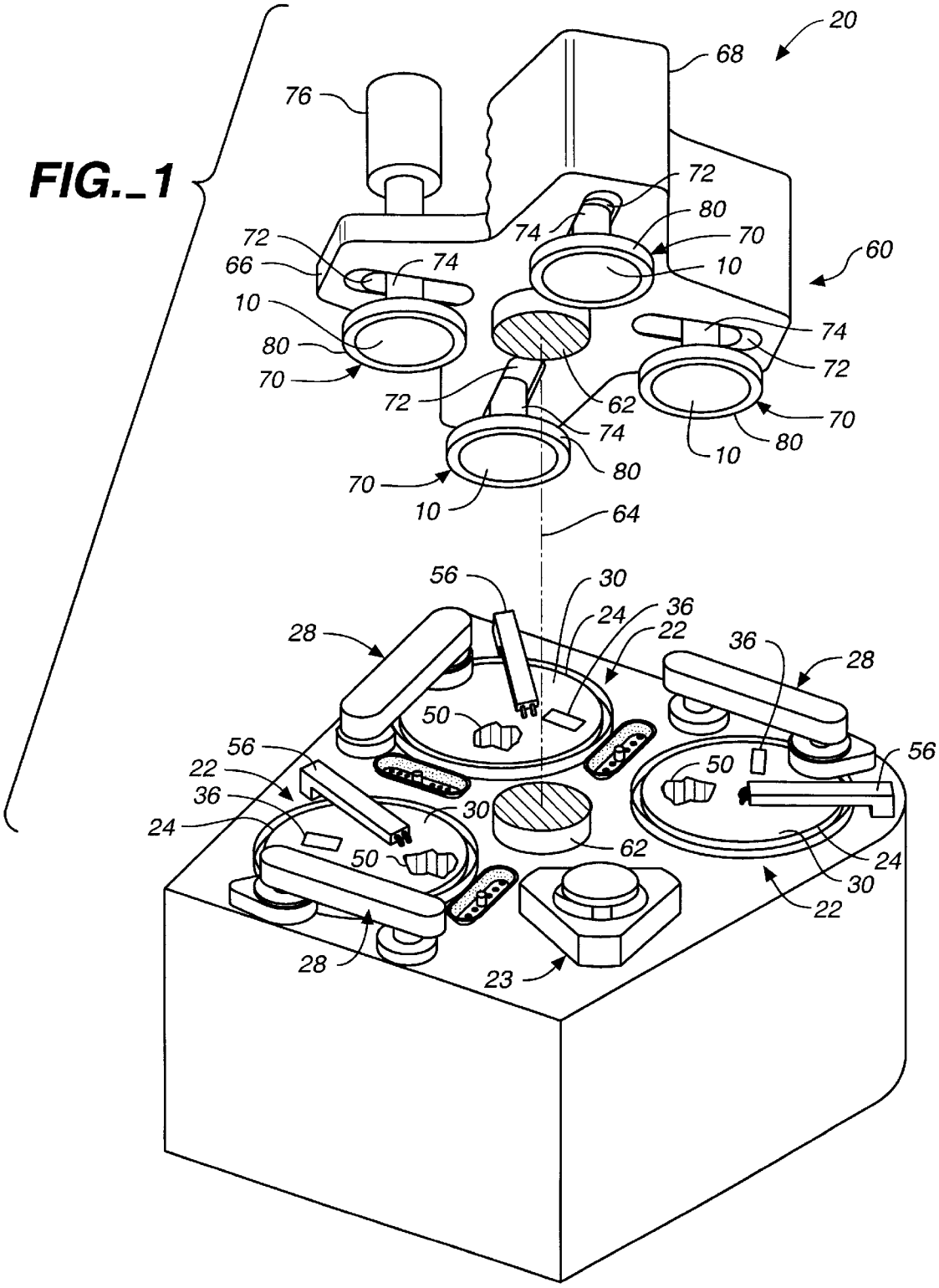
FIG. 1 is an exploded perspective view of a chemical mechanical polishing apparatus.
Figure 2:
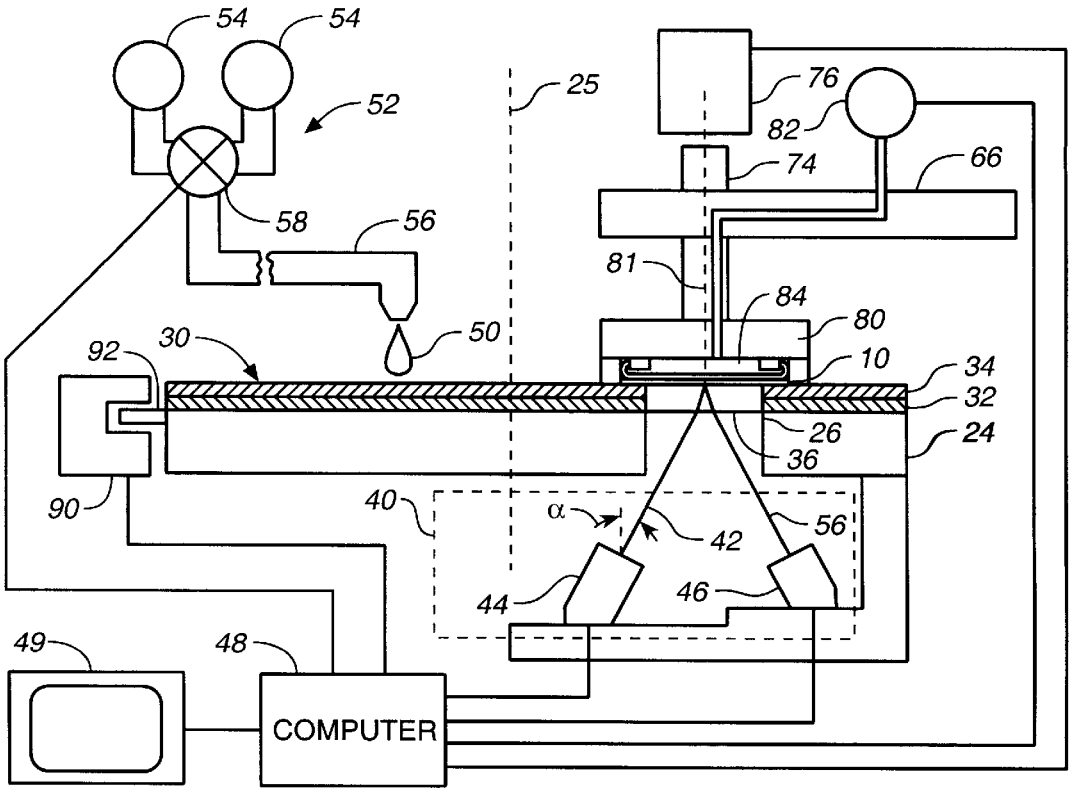
FIG. 2 is a side view of a chemical mechanical polishing apparatus including an optical monitoring system.

Referring to FIGS. 1 and 2, one or more substrates 10 may be polished by a CMP apparatus 20. A description of a similar polishing apparatus 20 may be found in U.S. Pat. No. 5,738,574, the entire disclosure of which is incorporated herein by reference. Polishing apparatus 20 includes a series of polishing stations 22 and a transfer station 23. Transfer station 23 serves multiple functions, including receiving individual substrates 10 from a loading apparatus (not shown), washing the substrates, loading the substrates into carrier heads, receiving the substrates from the carrier heads, washing the substrates again, and finally, transferring the substrates back to the loading apparatus.

Each polishing station includes a rotatable platen 24 on which is placed a polishing pad 30. The first and second stations may include a two-layer polishing pad with a hard durable outer surface or a fixed-abrasive pad with embedded abrasive particles, whereas the final polishing station may include a relatively soft pad. A two-layer polishing pad 30 typically has a backing layer 32 which abuts the surface of platen 24 and a covering layer 34 which is used to polish substrate 10. Covering layer 34 is typically harder than backing layer 32.

A rotatable multi-head carousel 60 is supported by a center post 62 and is rotated thereon about a carousel axis 64 by a carousel motor assembly (not shown). Center post 62 supports a carousel support plate 66 and a cover 68. Carousel 60 includes four carrier head systems 70. Center post 62 allows the carousel motor to rotate carousel support plate 66 and to orbit the carrier head systems and the substrates attached thereto about carousel axis 64. Three of the carrier head systems receive and hold substrates, and polish them by pressing them against the polishing pads. Meanwhile, one of the carrier head systems receives a substrate from and delivers a substrate to transfer station 23.

Each carrier head system includes a carrier or carrier head 80. A carrier drive shaft 74 connects a carrier head rotation motor 76 (shown by the removal of one quarter of cover 68) to each carrier head 80 so that each carrier head can independently rotate about it own axis. There is one carrier drive shaft and motor for each head. In addition, each carrier head 80 independently laterally oscillates in a radial slot 72 formed in carousel support plate 66. Each carrier head 80 is associated with a pressure mechanism, such as a pressure source 82 to control the pressure in a chamber 84 in the carrier head or a pneumatic actuator to change the vertical position of the carrier head. The pressure mechanism controls the pressure of the substrate against the polishing pad.

The carrier head 80 performs several mechanical functions. Generally, the carrier head holds the substrate against the polishing pad, evenly distributes a downward pressure across the back surface of the substrate, transfers torque from the drive shaft to the substrate, and ensures that the substrate does not slip out from beneath the carrier head during polishing operations. In operation, the platen is rotated about its central axis 25, and the carrier head is rotated about its central axis 81 and translated laterally across the surface of the polishing pad.

One or more slurries 50 containing a reactive agent (e.g., deionized water for oxide polishing) and a chemically-reactive catalyzer (e.g., potassium hydroxide for oxide polishing) may be supplied to the surface of polishing pad 30 by a slurry supply system 52. If polishing pad 30 is a standard pad, slurry 50 may also include abrasive particles (e.g., silicon dioxide for oxide polishing). At each station, slurry supply system 52 can include multiple slurry sources 54 fluidly connected by a valve 58 to a slurry supply port or combined slurry/rinse arm 56. By controlling valve 58, different slurry compositions can be directed to the polishing pad surface.

A hole 26 is formed in platen 24 and a transparent window 36 is formed in a portion of polishing pad 30 overlying the hole. Hole 26 and transparent window 36 are positioned such that they have a view of substrate 10 during a portion of the platen's rotation, regardless of the translational position of the carrier head.

An optical monitoring system 40, which can function as a reflectometer or interferometer, is secured to platen 24 generally beneath hole 26 and rotates with the platen. The optical monitoring system includes a light source 44 and a detector 46. The light source generates a light beam 42 which propagates through transparent window 36 and slurry 50 (see FIG. 3) to impinge upon the exposed surface of substrate 10. For example, the light source 44 may be laser and the light beam 42 may be a collimated laser beam. The light laser beam 42 is projected from laser 44 at an angle $\alpha$ from an axis normal to the surface of substrate 10, i.e., at an angle $\alpha$ from axes 25 and 81. In addition, if the hole 26 and window 36 are elongated, a beam expander (not illustrated) may be positioned in the path of the light beam to expand the light beam along the elongated axis of the window. Laser 44 may operate continuously. Alternatively, the laser may be activated to generate laser beam 42 during a time when hole 26 is generally adjacent substrate 10.

The CMP apparatus 20 may include a position sensor 90, such as an optical interrupter, to sense when window 36 is near the substrate. For example, the optical interrupter could be mounted at a fixed point opposite carrier head 80. A flag 92 is attached to the periphery of the platen. The point of attachment and length of flag 92 is selected so that it interrupts the optical signal of sensor 90 at least while window 36 sweeps beneath substrate 10.

In operation, CMP apparatus 20 uses optical monitoring system 40 to determine when to halt polishing. A general purpose programmable digital computer 48 may be connected to laser 44, detector 46 and sensor 90. Computer 48 may be programmed to activate the laser when the substrate generally overlies the window, to store intensity measurements from the detector, to display the intensity measurements on an output device 49, to sort the intensity measurements into radial ranges, and to detect the polishing endpoint. Computer 48 may also be connected to pressure mechanism 82 to controls the pressure applied by carrier head 80, to carrier head rotation motor 76 to control the carrier head rotation rate, to the platen rotation motor (not shown) to control the platen rotation rate, or to slurry distribution system 52 to control the slurry composition supplied to the polishing pad.

Figure 3:
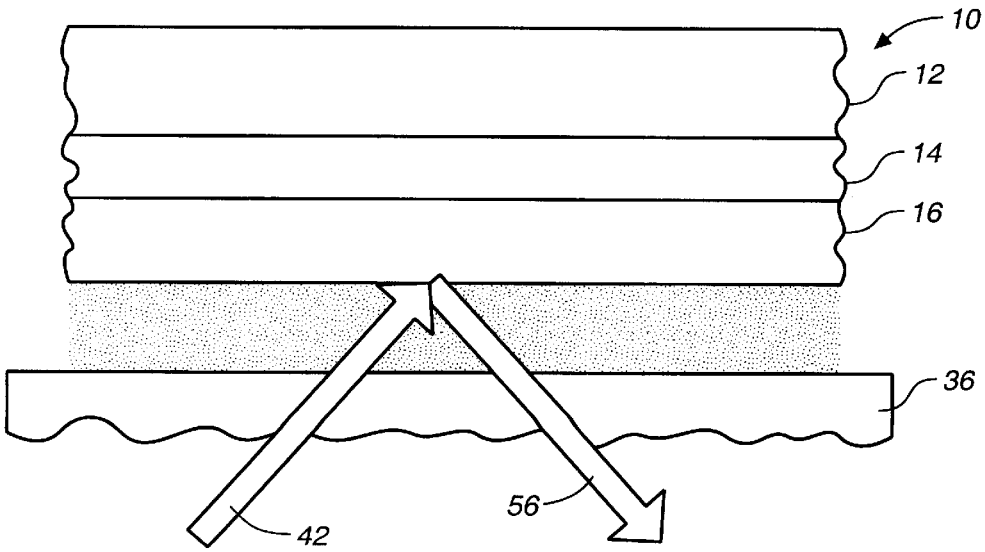
FIG. 3 is a simplified cross-sectional view of a substrate being processed, schematically showing a laser beam impinging on and reflecting from the substrate.

Referring to FIG. 3, for metal polishing, a substrate 10 includes a silicon wafer 12 and a metal layer 16 disposed over an oxide or nitride layer 14 that is itself patterned or disposed over another patterned layer. The metal may be copper, tungsten, or aluminum, among others. As different portions of the substrate with different reflectivities are polished, the signal output from the detector 46 varies with time. The time varying output of detector 46 may be referred to as an in-situ reflectance measurement trace (or more simply, a reflectance trace). As discussed below, this reflectance trace may be used to determine the end-point of the metal layer polishing operation.

Figure 4:
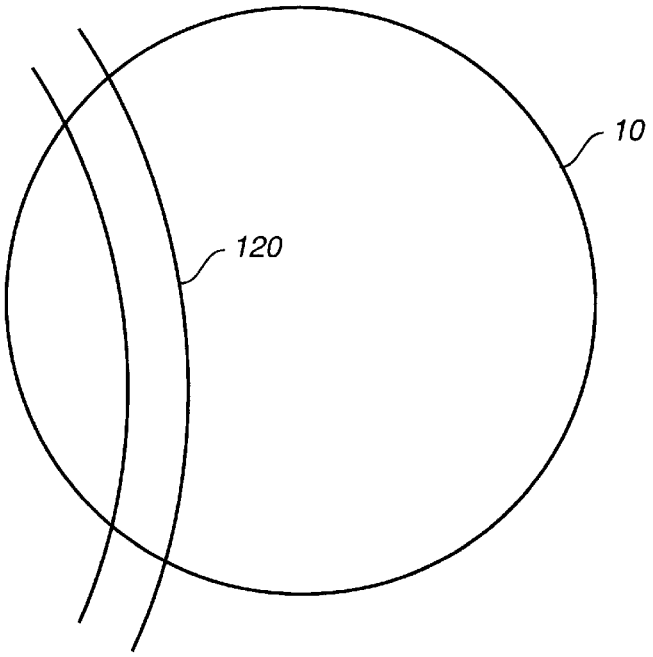
FIG. 4 is a schematic view illustrating the path of a laser beneath the carrier head.
Figure 5:
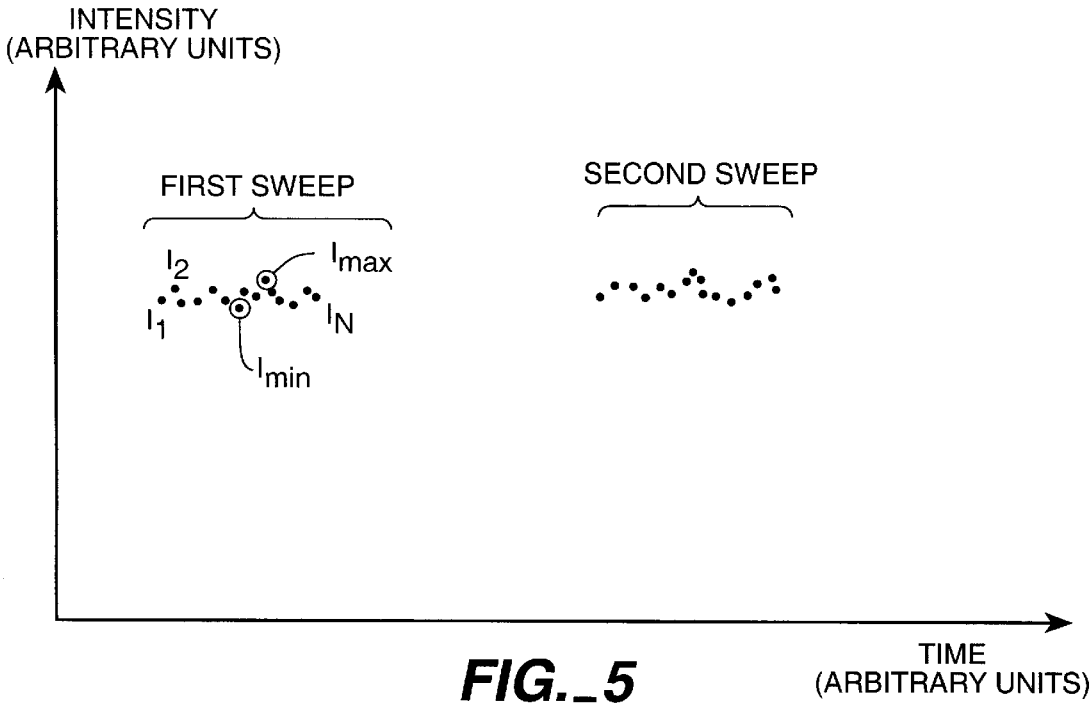
FIG. 5 is a graph showing hypothetical intensity measurements from the optical monitoring system.

Referring to FIG. 4, the combined rotation of the platen and the linear sweep of the carrier head causes window 36 (and thus laser beam 42) to sweep across the bottom surface of carrier head 80 and substrate 10 in a sweep path 120. Referring to FIG. 5, each time the laser beam sweeps across the substrate, optical monitoring system 40 generates a series of intensity measurements $I_1, I_2, I_3, \ldots, I_N$ (the number N can differ from sweep to sweep). The sample rate F (the rate at which intensity measurements are generated) of optical monitoring system 40 may be about 500 to 2000 Hertz (Hz), or even higher, corresponding to a sampling period between about 0.5 and 2 milliseconds.

When computer 48 processes the signal from the optical monitoring system, one or more values are extracted from each series of intensity measurements $I_1, I_2, I_3, \ldots, I_N$. For example, a series of intensity measurements from a single sweep can be averaged to generate a mean intensity $I_{MEAN}$. Alternately, the computer can extract the minimum intensity $I_{MIN}$ or the maximum intensity $I_{MAX}$ from the series. In addition, the computer can generate an intensity difference $I_{DIF}$ equal to the difference between the maximum and minimum intensities, i.e., $I_{MAX}-I_{MIN}$.

Figure 6:
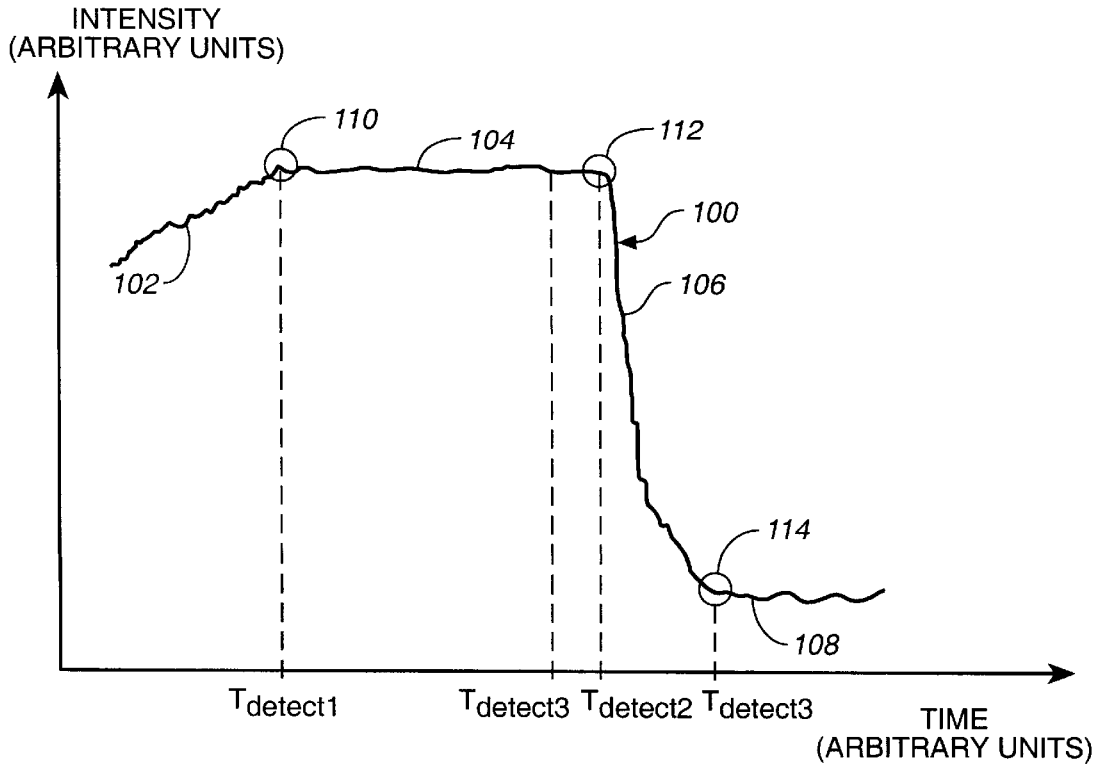
FIG. 6 is a graph showing a hypothetical intensity trace generated from multiple sweeps of the window beneath the carrier head.

A series of values extracted by computer 48 for a series of sweeps can be stored in memory or non-volatile storage. Referring to FIG. 6, this series of extracted values (with one extracted value per sweep) can be assembled and displayed as a function of measurement time to provide the time-varying trace 100 of the reflectivity of the substrate. This time-varying trace may also be filtered to remove noise.

The overall shapes of intensity trace 100 may be explained as follows. Initially, the metal layer 16 has some initial topography because of the topology of the underlying patterned layer 14. Due to this topography, the light beam scatters when it impinges the metal layer. As the polishing operation progresses in section 102 of the trace, the metal layer becomes more planar and the reflectivity of the polished metal layer increases. As the bulk of the metal layer is removed in section 104 of the trace, the intensity remains relatively stable. Once the oxide layer begins to be exposed in the trace, the overall signal strength drops quickly in section 106 of the trace. Once the oxide layer is entire exposed in the trace, the intensity stabilizes again in section 108 of the trace, although it may undergo small oscillations due to interferometric effects as the oxide layer is removed.

As intensity data is collected and the time-varying intensity trace is generated, computer 48 performs a pattern recognition process to search for a series of endpoint criteria 110, 112 and 114 in the time-varying trace 100 that will trigger the polishing endpoint. Although a series of three endpoint criteria are illustrated, there could be just one or two endpoint criteria, or four or more endpoint criteria. Each endpoint criterion can include one or more endpoint conditions. Possible endpoint conditions include a local minimum or maximum, a change in slope, or a threshold value in intensity or slope, or a combination thereof. The endpoint criteria are typically set by the operator of the polishing machine through experimentation, analysis of endpoint traces from test wafers, and optical simulations. For example, when monitoring a reflectivity trace during metal polishing, the operator may instruct the polishing machine to cease polishing if the computer 48 detects a leveling out 110, a sharp drop-off 112, and another leveling out 114. Although the endpoint criteria shown in FIG. 6 are associated with changes in the slope of the intensity trace, other endpoint criteria could be used. In general, once the last endpoint criterion has been detected, the polishing operation is halted. Alternatively, polishing continue for a preset period of time after detection of the last endpoint criterion, and then halted.

Unfortunately, under some circumstances, the signal from the optical detector may be too weak or noisy for computer 48 to detect the endpoint criteria. In addition, due to the rapidly changing slope of the intensity trace 100, the polishing endpoint may not be calculated accurately.

Figure 7:
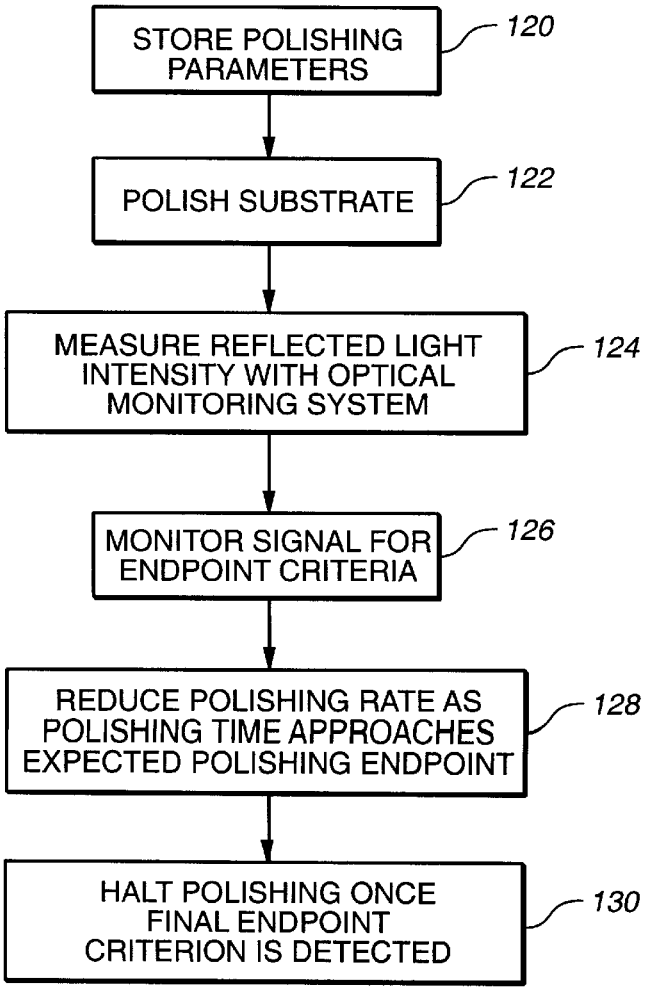
FIG. 7 is a flow chart of a method of determining a polishing endpoint

Referring now to FIG. 7, a modified end-point determining process is shown. First, several polishing parameters that will be used during the end-point determination are stored in the memory of computer 48 (step 120). The polishing parameters of interest include the carrier head pressure, the rotation rates of the carrier head and platen rotation rate, the expected polishing end time, and a default time to modify the polishing parameters.

A layer on a surface of the substrate 12 is polished (step 122) by bringing the surface of the substrate into contact with the polishing pad 30 (FIG. 2). The polishing pad 30 is rotated, causing relative motion between the substrate and the polishing pad.

Each time the window passes beneath the substrate, the reflected intensity from the substrate is measured (step 124). The intensity is collected, and the time-varying intensity trace is generated. The computer performs a pattern recognition program to the intensity trace to detect the endpoint criteria (step 126).

As the substrate approaches completed polishing at an expected polishing endpoint, computer 48 modifies the polishing parameters to reduce the polishing rate (step 128). Specifically, in a polishing operation (such as metal, polysilicon or shallow trench isolation) in which a covering layer is polished until the underlying patterned layer is exposed, the polishing rate can be reduced before the underlying layer is initially exposed. The polishing rate is reduced by about a factor of 2 to 4, i.e., by about 50% to 75%. To reduce the polishing rate, the carrier head pressure can be reduced, the carrier head rotation rate can be reduced, the composition of the slurry can be changed to introduce a slower polishing slurry, and/or the platen rotation rate could be reduced. For example, the pressure on the substrate from the carrier head may be reduced by about 33% to 50%, and the platen rotation rate and carrier head rotation rate may both be reduced by about 50%.

By reducing the polishing rate before the underlying dielectric layer is exposed, dishing and erosion effects can be reduced. In addition, the relative reaction time of the polishing machine is improved, enabling the polishing machine to halt polishing with less material removed after the final endpoint criterion is detected. Moreover, more intensity measurements can be collected near the expected polishing end time, thereby potentially improving the accuracy of the polishing endpoint calculation. However, by maintaining a high polishing rate throughout most of the polishing operation, high throughput is achieved. Preferably, at least 75%, e.g., 80–90%, of the bulk polishing of the metal layer is completed before the carrier head pressure is reduced or other polishing parameters are changed.

The time at which computer 48 reduces the polishing rate can be set by a default time $T_{default}$ selected by the operator of the polishing machine through experimentation and analysis of endpoint traces from test wafers. Alternately, the time at which the polishing parameters are changed to reduce the polishing rate can be calculated from the endpoint criteria detected during polishing of the substrate. For example, the time can be a multiple of or a preset margin following the time $T_{detect1}$ at which the first endpoint criteria is detected.

Once the computer detects the final endpoint criterion, polishing is halted, either immediately or after a preset time has elapsed (step 130). It should be noted that in selecting the exact values for the final endpoint criterion, the polishing machine operator can take into account the reduced polishing rate near the expected polishing endpoint.

Given the average, minimum, maximum and differential intensity traces, a wide variety of endpoint detection algorithms can be implemented. Separate endpoint criteria (e.g., based on local minima or maxima, slope, or threshold values) can be created for each type of trace, and the endpoint conditions for the various traces can be combined with Boolean logic. The intensity traces may also be created for a plurality of radial ranges on the substrate. The generation of intensity traces for a plurality of radial ranges is discussed in U.S. application Ser. No. 09,184,767, filed Nov. 2, 1998, the entirety of which is incorporated by reference.

The endpoint criteria can also be used to trigger a change in polishing parameters. For example, when the optical monitoring system detects the second endpoint criterion, the CMP apparatus may change the slurry composition (e.g., from a high-selectivity slurry to a low selectivity slurry).

Although one implementation has been described for an reflectance signal from a metal polishing operation, the endpoint detection process would be applicable to other polishing operations, such as dielectric polishing, and to other optical monitoring techniques, such as interferometry, spectrometry and ellipsometry. In addition, although the invention has been described in terms of an optical monitoring system, principles of the invention may also be applicable to other chemical mechanical polishing endpoint monitoring systems, such as capacitance, motor current, or friction monitoring system.

The present invention has been described in terms of a preferred embodiment. The invention, however, is not limited to the embodiment depicted and described. Rather, the scope of the invention is defined by the appended claims.

What is claimed is:

1. A computer-implemented endpoint detection method for a chemical mechanical polishing operation, comprising:

measuring a polishing time of a substrate being polished by a chemical mechanical polishing system at a first polishing rate;

receiving a signal from a polishing endpoint detection system;

monitoring the signal for an endpoint criterion;

modifying a polishing parameter of the chemical mechanical polishing operation so as to reduce a polishing rate of the substrate being polished to a second polishing rate which is less than the first polishing rate when the polishing time approaches an expected polishing end time but before the endpoint criterion is detected; and stopping polishing once the endpoint criterion is detected.

2. The method of claim 1, wherein endpoint detection system optically monitors a substrate.

3. The method of claim 2, wherein the polishing operation polishes a metal layer on the substrate.

4. The method of claim 2, wherein the polishing operation polishes a dielectric layer on the substrate.

5. The method of claim 1, further comprising storing a default time at which the polishing parameter is modified.

6. The method of claim 1, further comprising calculating a time at which the polishing parameter is modified from the signal received from the endpoint monitoring system.

7. The method of claim 1, wherein modifying the polishing parameter includes reducing a pressure on the substrate.

8. The method of claim 1, wherein modifying the polishing parameter includes reducing a relative speed between the substrate and a polishing surface.

9. The method of claim 1, wherein the substrate includes a first layer disposed over a second layer, and the polishing rate is reduced before the second layer is exposed.

10. The method of claim 9, wherein the first layer is copper and the second layer is silicon oxide.

11. A method of chemical mechanical polishing, comprising:

bringing a substrate into contact with a polishing surface;

creating relative motion between the substrate and the polishing surface to polish the substrate at a first polishing rate;

measuring a polishing time of the substrate;

generating a signal with a polishing endpoint detection system;

monitoring the signal for an endpoint criterion;

reducing a polishing rate of the substrate being polished to a second polishing rate which is less than the first polishing rate when the polishing time approaches an expected polishing end time but before the endpoint criterion is detected; and stopping polishing once the endpoint criterion is detected.

12. The method of claim 1, wherein endpoint detection system optically monitors the substrate.

13. The method of claim 11, wherein changing a polishing parameter includes reducing a pressure on the substrate.

14. The method of claim 11, wherein changing a polishing parameter includes reducing a relative speed between the substrate and the polishing surface.

15. A method of chemical mechanical polishing a substrate having a first layer disposed on a second layer, comprising:

bringing the first layer of the substrate into contact with a polishing surface;

creating relative motion between the substrate and the polishing surface to polish the first layer of the substrate at a first polishing rate;

reducing a polishing rate of the substrate to a second polishing rate which is less than the first polishing rate before the second layer is exposed; and stopping polishing after the second layer has been exposed.

16. The method of claim 15, wherein reducing the polishing rate includes measuring a polishing time of the substrate with a computer, storing a parameter change time in the computer, and modifying a polishing parameter when the polishing time reaches the parameter change time.

17. The method of claim 15, wherein stopping polishing includes generating a signal with a polishing endpoint detection system, monitoring the signal for an endpoint criterion, and stopping polishing once the endpoint criterion is detected.

18. A chemical mechanical polishing apparatus, comprising:

a polishing surface;

a carrier head to hold a substrate into contact with the polishing surface;

a motor coupled to at least one of the polishing surface and the carrier head to create relative motion therebetween;

a polishing endpoint detection system;

a controller to receive a signal from the endpoint system, the controller configured to measure a polishing time of a substrate during a polishing operation, polish the substrate at a first polishing rate, monitor the signal for an endpoint criterion, modify a polishing parameter so as to reduce a polishing rate of the substrate to a second polishing rate which is less than the first polishing rate when the polishing time approaches an expected polishing end time but before the endpoint criterion is detected, and stop polishing of the substrate once the endpoint criterion is detected.

19. A computer-implemented endpoint detection method for a chemical mechanical polishing operation, comprising:

measuring a total polishing time of a substrate being polished by a chemical mechanical polishing system;

receiving a signal from a polishing endpoint detection system;

monitoring the signal for an endpoint criterion;

comparing the total polishing time to a default time which is less than an expected polishing end time;

modifying a polishing parameter of the chemical mechanical polishing operation so as to reduce a polishing rate of the substrate being polished when the default time has elapsed; and stopping polishing once the endpoint criterion is detected.

* * * * *

UNITED STATES PATENT AND TRADEMARK OFFICE

CERTIFICATE OF CORRECTION

PATENT NO. : 6,309,276 B1 
DATED : October 30, 2001
INVENTOR(S) : Stan Tsai, Kapila Wijekoon and Fritz C. Redeker It is certified that error appears in the above-identified patent and that said Letters Patent is hereby corrected as shown below:

Column 9,
Line 11, change "1" to -- 11 --.

Signed and Sealed this

Thirteenth Day of August, 2002

*Attest:*

*Attesting Officer*

JAMES E. ROGAN
*Director of the United States Patent and Trademark Office*